US008077895B2

(12) United States Patent
Kral et al.

(10) Patent No.: US 8,077,895 B2
(45) Date of Patent: Dec. 13, 2011

(54) BEHIND-THE-EAR HEARING AID WITH AUDIO SHOE WHICH CAN BE PUSHED-ON LINEARLY, AND APPROPRIATE MOUNTING METHOD

(75) Inventors: Holger Kral, Fürth (DE); Michael Sattler, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 736 days.

(21) Appl. No.: 12/221,936

(22) Filed: Aug. 7, 2008

(65) Prior Publication Data

US 2009/0041277 A1 Feb. 12, 2009

(30) Foreign Application Priority Data

Aug. 10, 2007 (DE) ..... 10 2007 037 877

(51) Int. Cl.
*H04R 25/00* (2006.01)

(52) U.S. Cl. ..... 381/322; 381/330; 381/312; 381/324

(58) Field of Classification Search ..... 381/322–330
See application file for complete search history.

(56) References Cited

U.S. PATENT DOCUMENTS

| | | | | |
|---|---|---|---|---|
| 4,964,170 | A | 10/1990 | Pöhacker | |
| 6,831,988 | B2 * | 12/2004 | Vonlanthen | 381/323 |
| 7,068,804 | B2 * | 6/2006 | Batting | 381/330 |
| 7,602,929 | B2 * | 10/2009 | Topholm et al. | 381/322 |
| 2006/0034474 | A1 | 2/2006 | Topholm et al. | |
| 2006/0126875 | A1 | 6/2006 | Kragelund | |
| 2006/0220611 | A1 * | 10/2006 | Choi | 320/112 |
| 2007/0147643 | A1 | 6/2007 | Grafenberg | |

FOREIGN PATENT DOCUMENTS

| | | | |
|---|---|---|---|
| DE | 10 2006 008 044 | B3 | 5/2007 |
| DE | 10 2005 061 795 | A1 | 7/2007 |
| EP | 0334837 | A2 | 9/1989 |
| WO | 2004080123 | A1 | 9/2004 |
| WO | 2004112431 | A1 | 12/2004 |

* cited by examiner

*Primary Examiner* — Steven Loke
*Assistant Examiner* — David Goodwin

(57) ABSTRACT

A behind-the-ear hearing aid is provided, with an elongated housing and an audio shoe, which is affixed to an end face of the housing in such a way that it can be removed, and a coupling device, with which the audio shoe is coupled to the housing by a sliding movement parallel to the end face of the housing. In addition, affixed to the audio shoe there is a securing device which includes a slider which can be moved crossways relative to the direction in which the audio shoe slides, which in a first position permits the sliding movement of the audio shoe and in a second position prevents the sliding movement. It is thus possible to mount the audio shoe on the hearing aid housing, and to make any necessary contacts, with a double linear movement which is easy to realize.

7 Claims, 11 Drawing Sheets

BEHIND-THE-EAR HEARING AID WITH AUDIO SHOE WHICH CAN BE PUSHED-ON LINEARLY, AND APPROPRIATE MOUNTING METHOD

CROSS REFERENCE TO RELATED APPLICATIONS

This application claims priority of German application No. 10 2007 037 877.9 DE filed Aug. 10, 2007, which is incorporated by reference herein in its entirety.

FIELD OF INVENTION

The present invention relates to a behind-the-ear hearing aid with an elongated housing and an audio shoe which is affixed to an end face of the housing in such a way that it can be removed. In addition, the present invention relates to a method for coupling an audio shoe to a behind-the-ear hearing aid.

BACKGROUND OF INVENTION

Hearing aids are portable hearing devices which serve to assist the hard of hearing. In order to meet the numerous individual needs, different designs of hearing aid are provided, such as behind-the-ear (BTE) hearing aids, hearing aids with external microphones (RIC: receiver in the canal), and in-the-ear (ITE) hearing aids, including for example concha hearing aids or canal hearing aids (ITC, CIC). The hearing aids itemized by way of example are worn on the outer ear or in the auditory canal. In addition however, bone conduction hearing aids, implantable or vibrotactile hearing aids are also available on the market. These effect stimulation of the damaged hearing either mechanically or electrically.

In principle hearing aids have as their essential components an input transducer, an amplifier and an output transducer. The input transducer is generally a sound receiver, e.g. a microphone, and/or an electromagnetic receiver, e.g. an induction coil. The output transducer is mostly realized as an electro-acoustic transducer, e.g. a miniature loudspeaker, or as an electromechanical transducer, e.g. a bone conduction hearing aid. The amplifier is commonly integrated into a signal processing unit. This constructional principle is shown in FIG. 1 by the example of a behind-the-ear hearing aid. A hearing aid housing 1 for wearing behind the ear has built into it one or more microphones 2 for receiving the sound from the environment. A signal processing unit 3, which is also integrated into the hearing aid housing 1, processes the microphone signals and amplifies them. The output signal from the signal processing unit 3 is transmitted to a loudspeaker or earphone 4 which outputs an acoustic signal. The sound is, if necessary, transmitted via a sound tube, which is fixed in the auditory canal with an otoplastic, to the device wearer's eardrum. The power supply for the hearing aid and in particular that for the signal processing unit 3 is provided by a battery 5 which is also integrated into the hearing aid housing 1.

For the purpose of accepting external audio signals, a so-called audio shoe is used in many cases for hearing aids. The audio shoe is affixed to the hearing aid so that the audio signals are transmitted from the audio shoe to the hearing aid by means of electrical contacts. Various methods have become established for affixing an audio shoe to the housing of a hearing aid. Under one method which originated from the applicant, the audio shoe is twisted onto the housing of the hearing aid with a rotational movement. However, there are also audio shoes which are plugged onto the hearing aid either from the side or into its axis, by a linear movement.

A hearing aid module is known, from the publication DE 10 2005 061 795 A1, which can be affixed mechanically and electrically by an electromechanical interface to a multi-purpose interface on a hearing aid. The interface can be made in such a form that the hearing aid module can be put onto the hearing aid via a rail-type guide.

From the publication US 2006/0034474 A1, a hearing aid is known to which can be affixed an adapter, and via this a supplementary device. The supplementary device can be affixed to the adapter via a rail-type connection, whereby for example an electrical connection can also be established, via contact areas (pads), at the same time as the mechanical one.

SUMMARY OF INVENTION

The object of the present invention consists in plugging an audio shoe onto a behind-the-ear device as simply and securely as possible.

This object is achieved in accordance with the invention by a behind-the-ear hearing aid with a elongated housing and an audio shoe, which can be affixed to an end face of the housing in such a way that it is removable, together with a coupling device with which the audio shoe is coupled to the housing by a sliding movement parallel to the end face of the housing, and a securing device affixed to the audio shoe which includes a slider, which can be moved crossways relative to the direction in which the audio shoe slides, which in a first position permits the sliding movement of the audio shoe and in a second position prevents the sliding movement.

Over and above this, an inventive method is provided for coupling an audio shoe onto a behind-the-ear hearing aid by a first linear sliding of two guide elements, on the audio shoe and the behind the ear hearing aid, into one another and a second linear sliding of a slider perpendicularly to the first sliding movement, so that the guide elements are inhibited from moving backwards relative to the first linear sliding.

It is thus advantageously possible with two simple movements to plug the audio shoe onto or to unplug it from the behind-the-ear hearing aid. This makes it simpler, in particular for older people, to manipulate small hearing aids with an audio shoe.

The coupling device will preferably have a dovetail guide. This permits an almost play-free seating of the audio shoe on the hearing aid and, if an end-stop is provided, leaves only one degree of freedom for the movements.

If a dovetail guide is used, it is particularly advantageous if a dovetail groove is attached on a battery compartment of the behind-the-ear device. This means that the coupling device does not stand proud of the surface of the hearing aid housing.

The slider of the securing device can be arranged on the surface of the audio shoe in such a way that it can slide. This makes it easy for the user to reach and operate it.

In accordance with one form of embodiment there are, permanently affixed on a side of the slider which faces the audio shoe, electrical contacts which when the slider is in the second position establish electrical connections between the audio shoe and the housing of the hearing aid. By this means, the electrical connection is only established when the slider is put into its second position, i.e. the fixing position, using the second linear sliding movement.

In accordance with an alternative form of embodiment there are electrical contacts, fixed on the slider, which can be moved inside the interior of the housing of the audio shoe by means of the slider and which, when the slider is in its second position, project through the above-mentioned end face of the hearing aid housing. By this means it is possible to ensure that the contacts on the hearing aid can be arranged inside the hearing aid housing. It is thereby possible largely to avoid corrosion and dirt.

Further, in the audio shoe can be arranged a securing element, which can be rotated about an axis of rotation parallel to the direction of movement of the slider into a first and a second position, so that the slider is fixed in its second position when the securing element is in its second position, and the slider is freely movable when the securing element is in its first position. In this way it is possible to avoid the unintentional release of the audio shoe from the hearing aid.

BRIEF DESCRIPTION OF THE DRAWINGS

The present invention is explained in more detail by reference to the attached drawings, in which are shown:

FIG. 6 the complete behind-the-ear hearing aid with the audio shoe plugged on;

DETAILED DESCRIPTION OF INVENTION

The forms of embodiment outlined below represent preferred forms of embodiment of the present invention.

Figure 1:
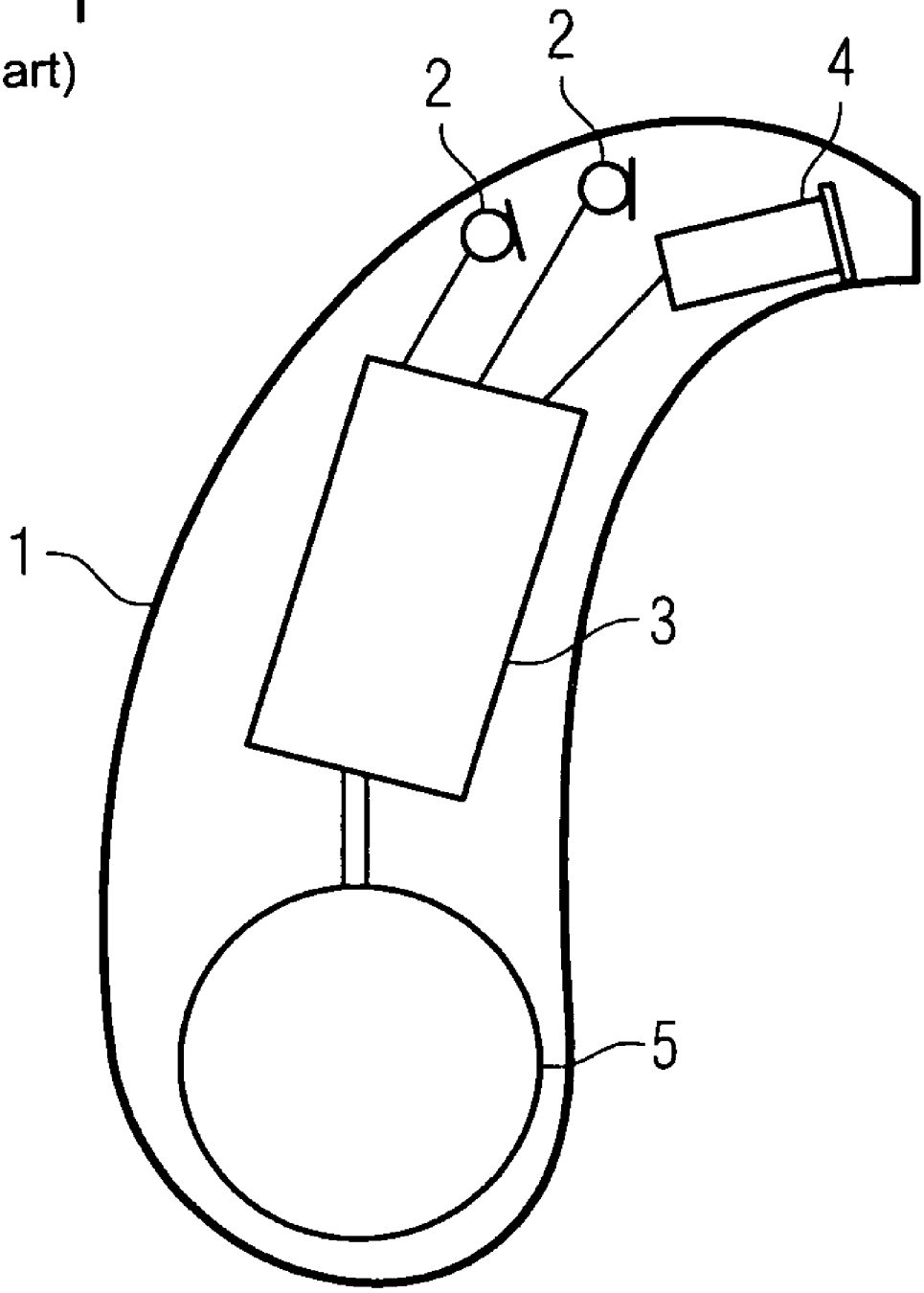
FIG 1 (Prior art)
FIG. 1 the principle of the structure of a hearing aid in accordance with the prior art.
Figure 2:
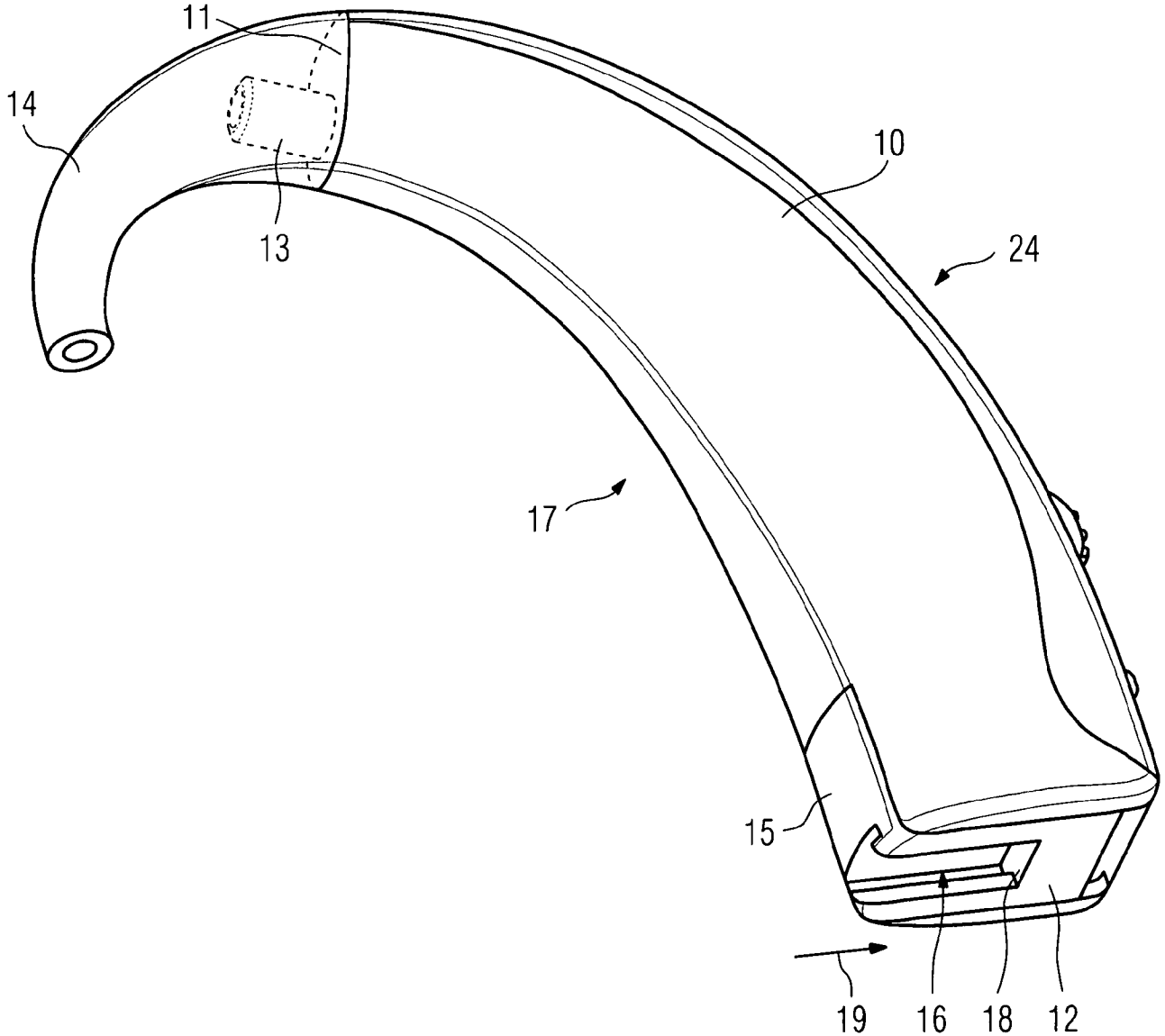
FIG. 2 a behind-the-ear hearing aid with groove for plugging on an audio shoe.

The schematic representation in FIG. 2 shows a behind-the-ear hearing aid without an audio shoe. The hearing aid has an elongated housing 10 with a first end face 11 and a second end face 12. On the first end face 11 there is a sound outlet 13, which opens out into a wearing hook 14. Arranged on the opposite, second end face 12 is a battery compartment 15, into which is formed a dovetail groove 16. The dovetail groove is open towards the curved inner side 17 of the housing 10. Furthermore, the dovetail groove 16 has an end stop 18, so that the audio shoe can be pushed into the dovetail groove up to a certain predefined position. Incidentally, the dovetail groove 16 runs parallel to the end face 12, so that the slide direction for pushing on the audio shoe and for releasing the audio shoe also runs parallel to the end face 12 of the housing 10.

Figure 3:
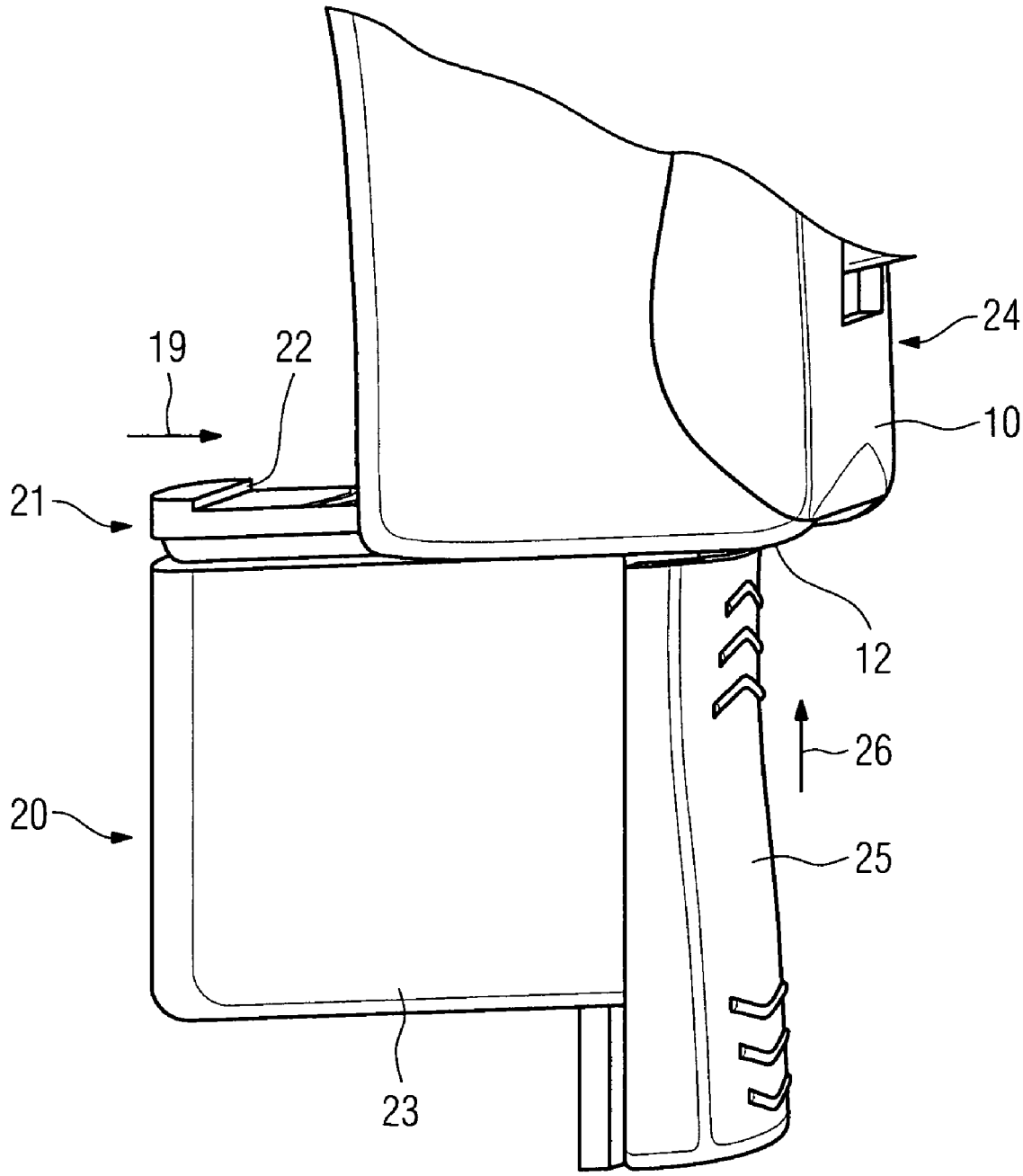
FIG. 3 an enlargement of the lower section of the hearing aid in FIG. 2 as the audio shoe is being pushed on along a first direction.

FIG. 3 shows an enlarged view of the lower part of the hearing aid housing 10. Also represented is an audio shoe 20, which has a dovetail 21 as a guide and coupling element. This too can be provided in addition with an end stop 22, which runs at right angles to the pushing-on direction 19. As shown in FIG. 3, the audio shoe 20 has already been partially pushed into the dovetail groove 16 on the hearing aid housing 10. The audio shoe 20 is thus affixed onto the hearing aid housing 10 by a first linear sliding movement 19.

In addition to this, the audio shoe 20 has a slider 25 on that outer side 23 of its housing which corresponds to the curved outer side 24 of the, hearing aid housing 10. It can be slid in a guide, perpendicular to the pushing-on direction 19, which corresponds to a locking direction 26. However, it cannot yet be slid with the audio shoe 20 in the position shown in FIG. 3, because if it were to move in the direction 26 it would bump into the end face 12 of the hearing aid housing 10. The slider 25 is thus located in a first position, in which the audio shoe 20 can slide in its pushing-on direction 19 or the opposite direction, as appropriate.

Figure 4:
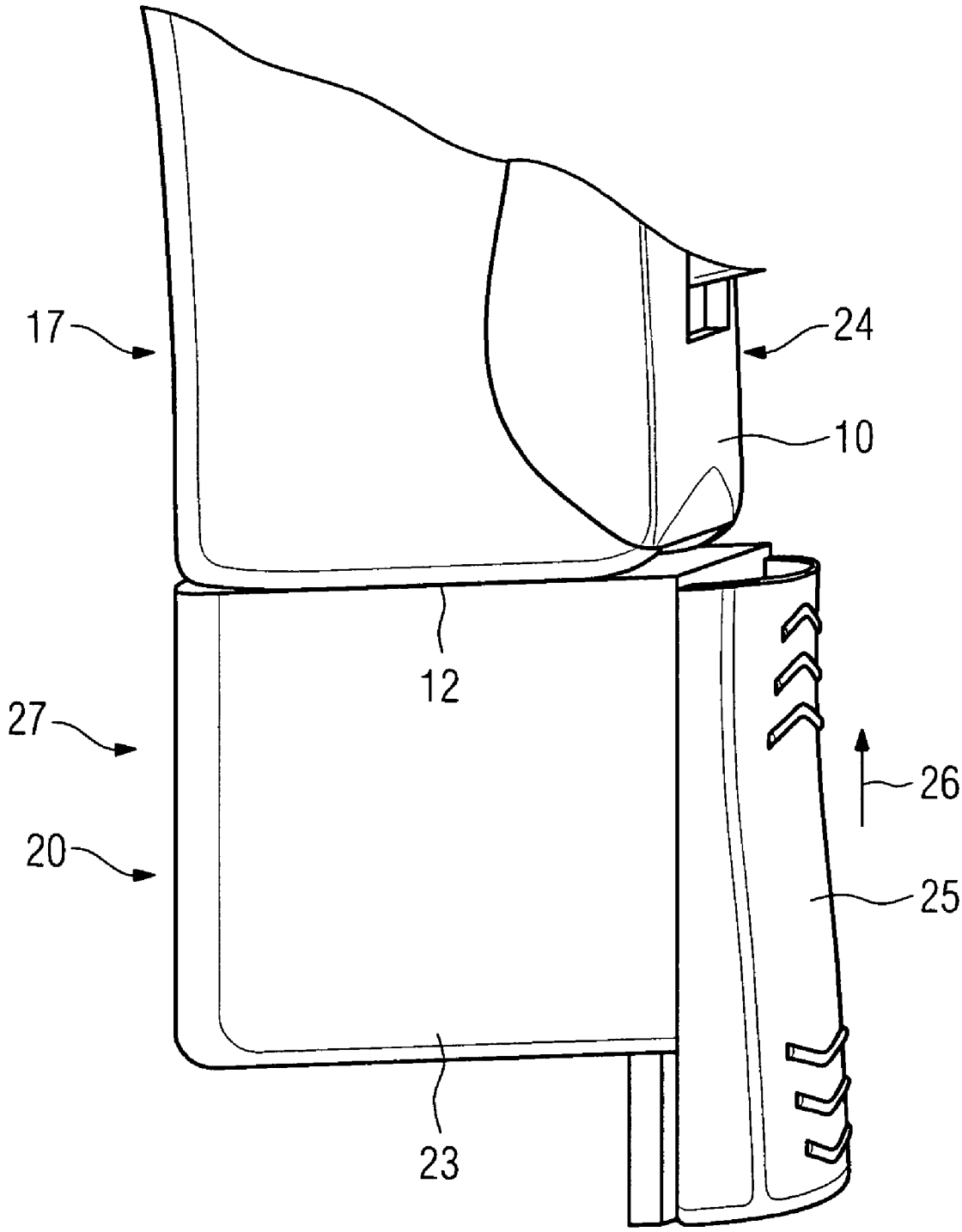
FIG. 4 the audio shoe in FIG. 3 in its pushed-on but unsecured state.

In FIG. 4, the audio shoe is now fully pushed into the dovetail groove which here serves as a part of the mechanical coupling device. The front side 27 of the audio shoe 20, which is opposite the slider 25, is then flush with the curved inner side 17 of the hearing aid housing 10. As before, the slider 25 is located in the first position, so that that audio shoe 20 can be pulled off the hearing aid housing 10. Now however, it is free to move in the securing direction 26, i.e. perpendicular to the end face 12.

Figure 5:
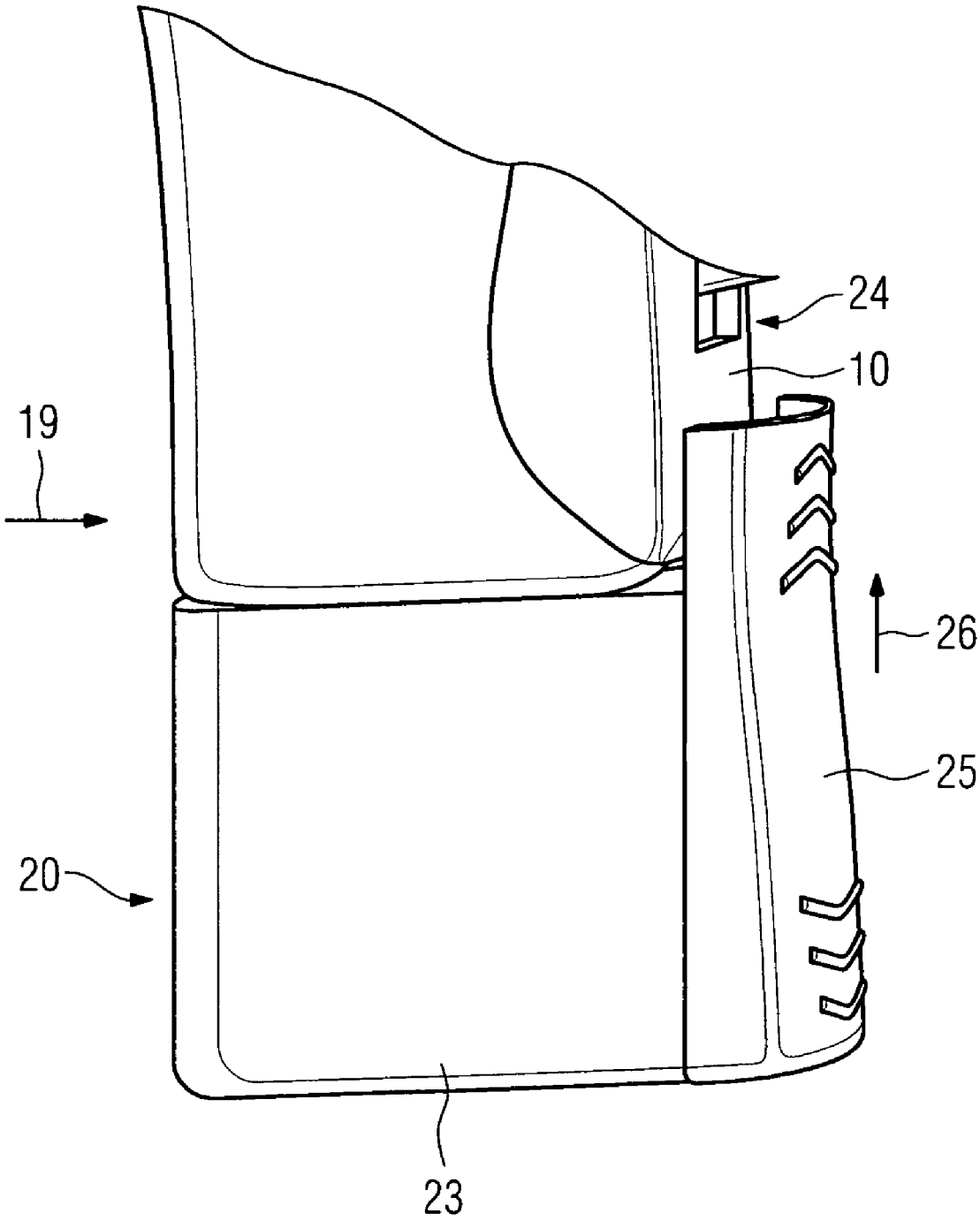
FIG. 5 the audio shoe in FIG. 4 in the secured state effected by sliding the slider along a second direction.

In FIG. 5, the slider 25 on the audio shoe 20 has been pushed in the direction up the hearing aid housing 10, to its end position. It is then located in its second position and prevents the audio shoe from moving in the direction opposite to the insertion direction 19, so that it could be pulled off the hearing aid housing 10. Specifically, a part of the slider 25 covers a section of the curved outer side 24 of the hearing aid housing 10.

Figure 6:
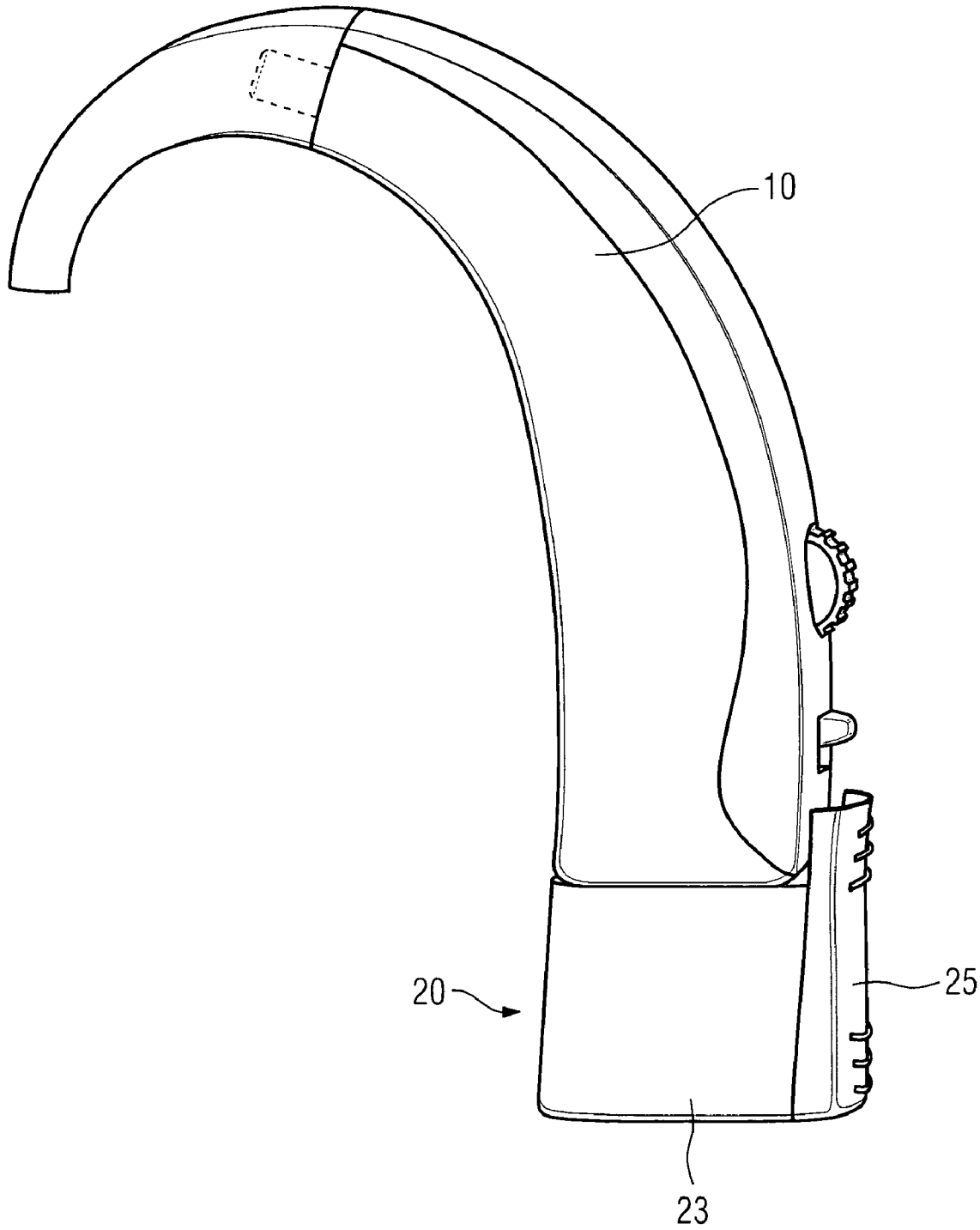

FIG. 6 shows the hearing aid of FIG. 2 with the audio shoe 20. The latter is located in the final mounted position on the hearing aid housing 10, as shown in FIG. 5. The slider 25 is also located in its second position, i.e. the securing position. It can be seen that the surface of the audio shoe housing 23 is essentially flush with that of the hearing aid housing 10 on at least three sides, so that an esthetically appealing overall impression results.

Figure 7:
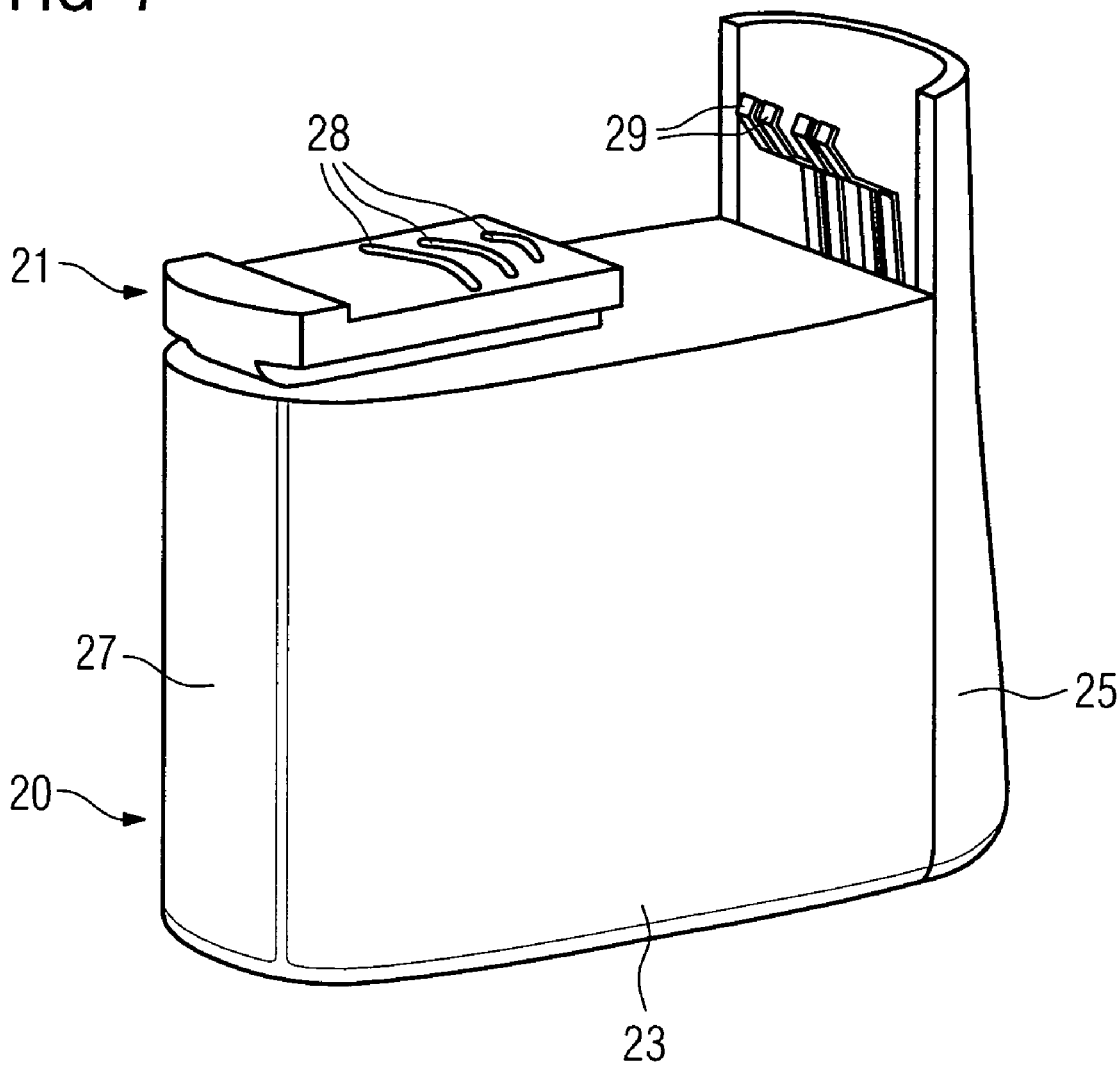
FIG. 7 the audio shoe with its electronic contacts.

In FIG. 7 the audio shoe 20 is shown looking obliquely from in front of it, i.e. onto its front side 27 (relative to its insertion direction 19). It is possible to see the dovetail 21, into the upper side of which are molded arrow-shaped indentations 28. They indicate to the wearer of the hearing aid the direction in which to plug the audio shoe 20 onto the hearing aid housing 10.

Also to be seen in FIG. 7 are contacts 29 on the inner side of the slider 25, which serve to make electrical connections from the audio shoe 20 to the hearing aid housing 10 or the electronic components accommodated in it, as applicable. Here, the slider 25 is located in its second position and only in this position can the spring contacts 29 press on the corresponding countercontacts in the hearing aid housing 10. On the other hand, with the slider 25 in the first position the contacts 29 are concealed between the slider 25 and the audio shoe housing 23. So the second linear sliding action, i.e. the sliding of the slider 25 into the second position, effects not only a mechanical securing of the audio shoe 20 on the hearing aid housing 10, but also the electrical connection of these two components.

Figure 8:
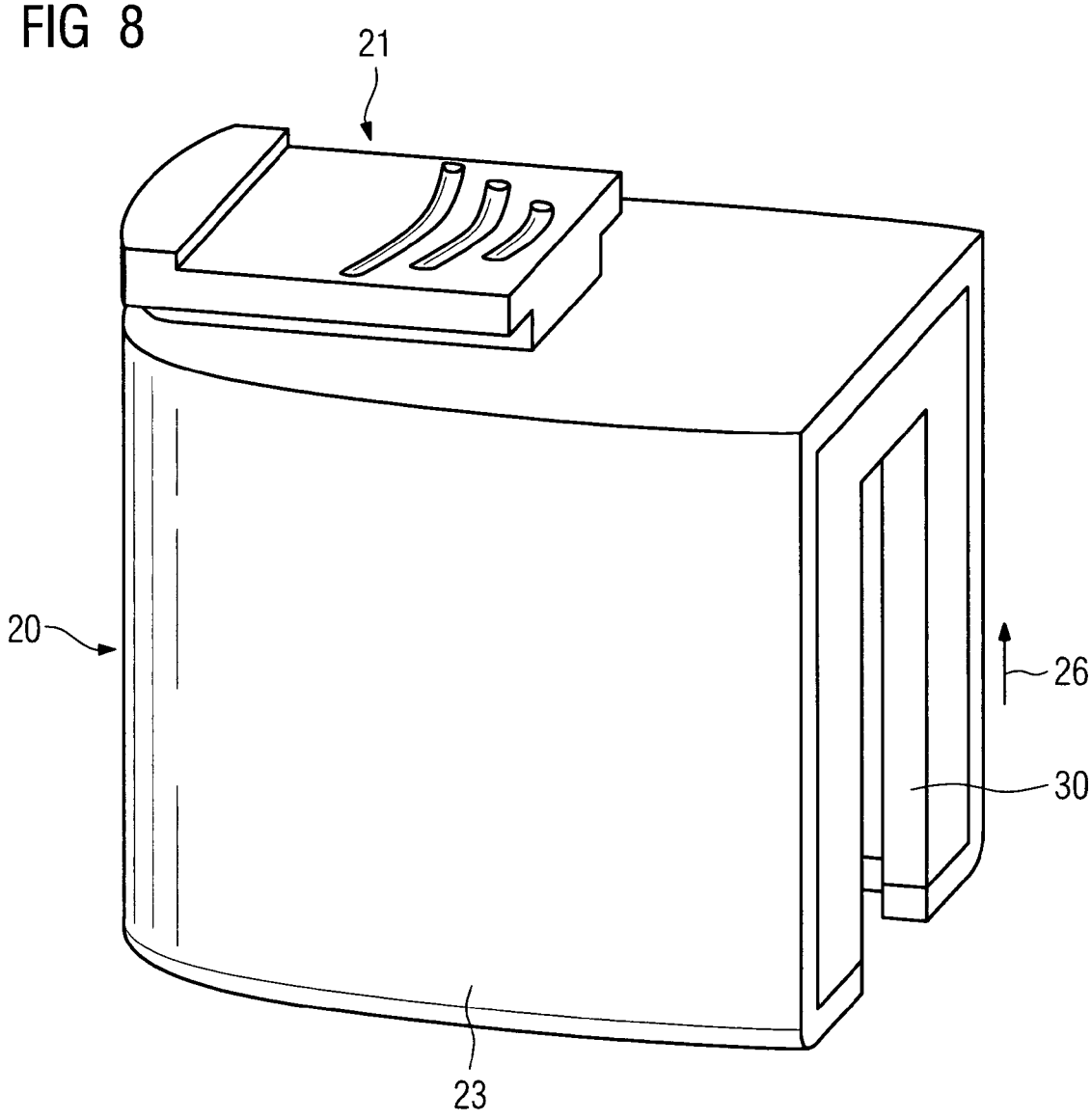
FIG. 8 the audio shoe in FIG. 7 without the slider.

FIG. 8 shows the audio shoe with the slider 25 removed. It is thus possible to see a groove 30 in the audio shoe housing 23, in which the slider 25 can be moved in the direction 26 and in the opposite direction.

Figure 9:
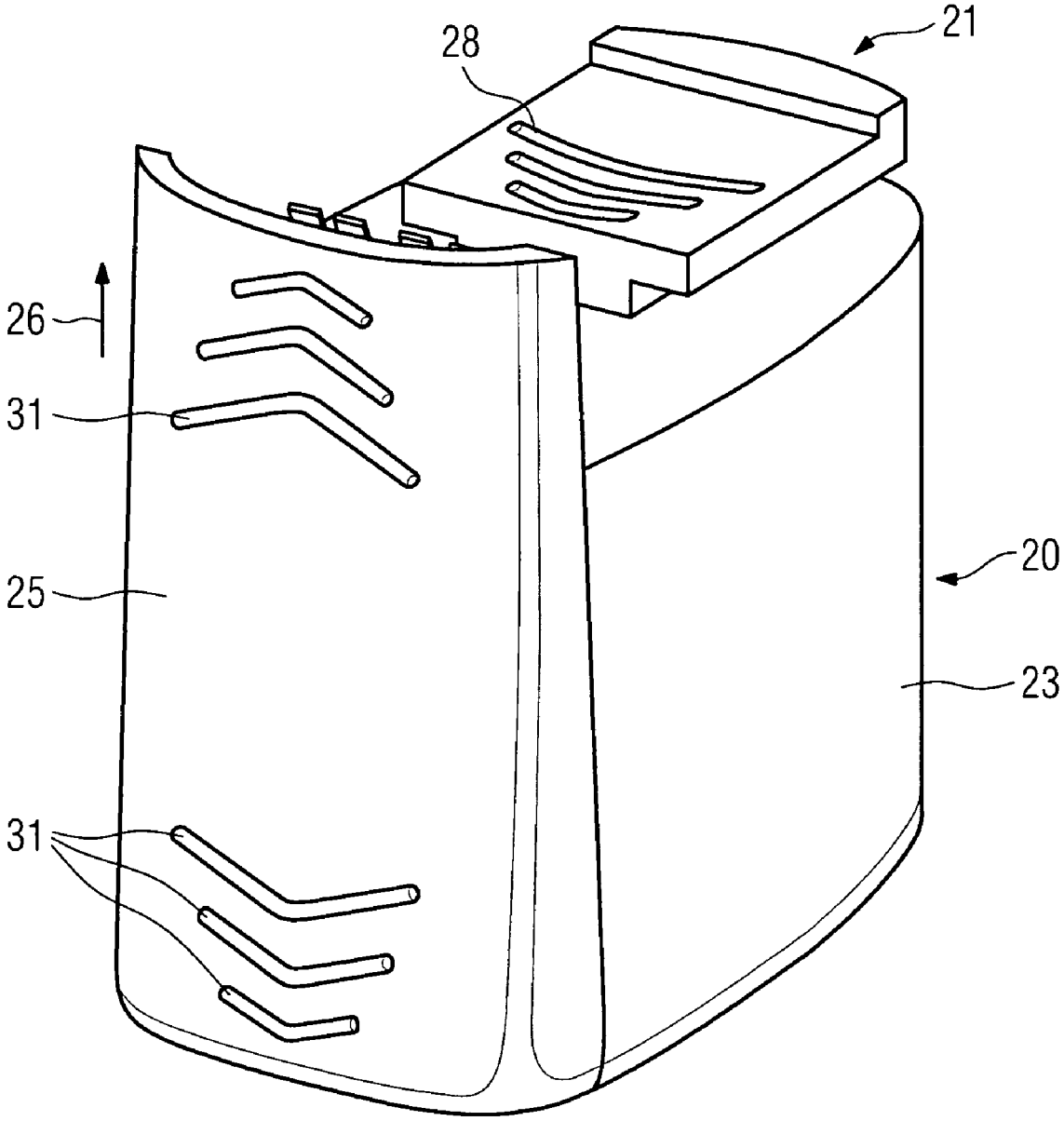
FIG. 9 the audio shoe in FIG. 7 from the opposite side.

FIG. 9 shows the audio shoe 20 directly from the rear, this time with the slider 25 reinserted. Molded onto the outer side of the slider there are again arrow-shaped indentations or raised areas 31, on the one hand to increase the ease of gripping the slider 25 and on the other hand to indicate to the wearer of the hearing aid the direction in which to slide the slider 25. So the slider 25 can be moved in the direction 26 to lock the coupling device and in the opposite direction to open it.

Figure 10:
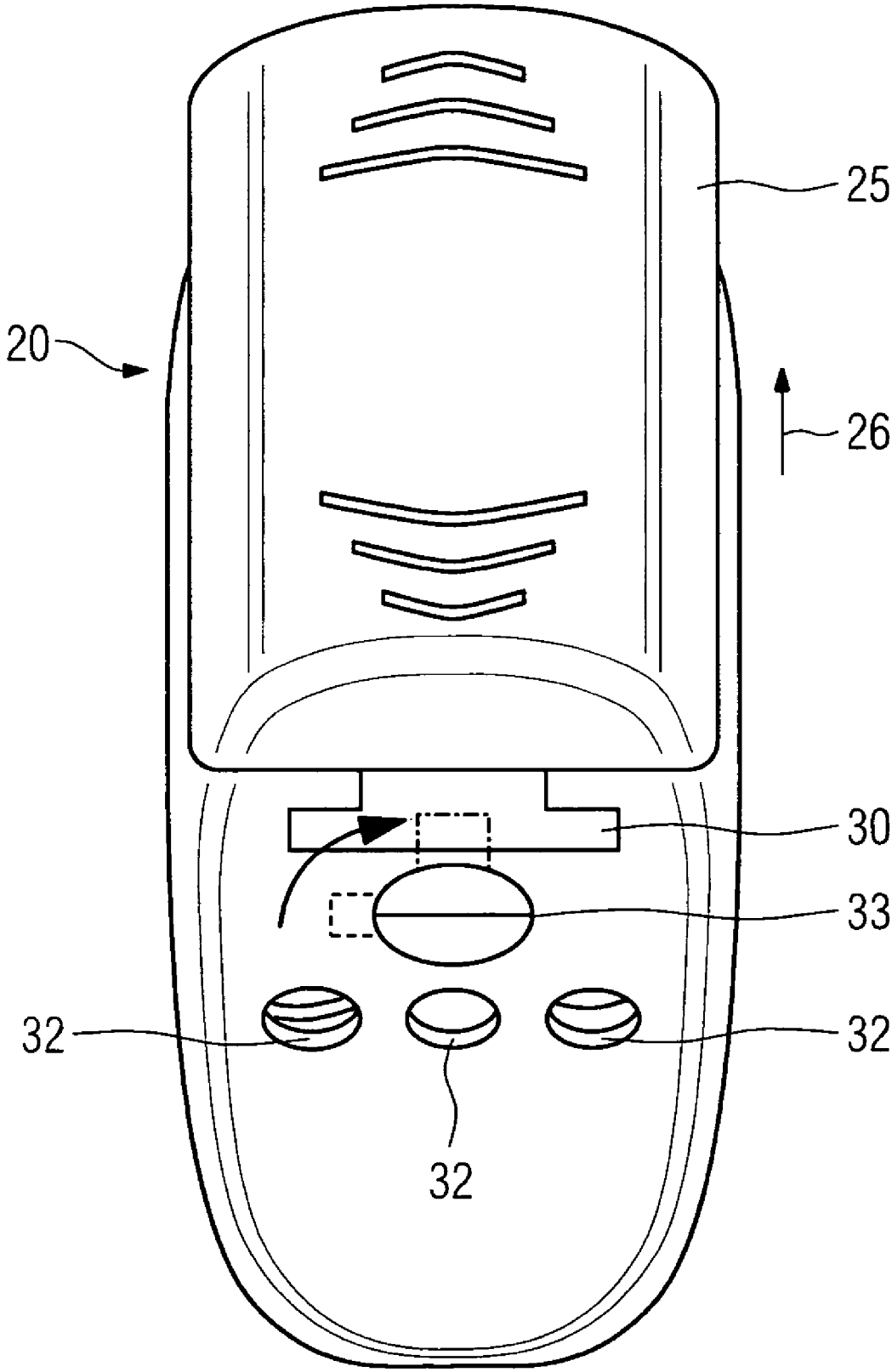
FIG. 10 the audio shoe in FIG. 7 from underneath.

FIG. 10 shows the audio shoe 20 from the underneath. It is possible to see there not only the groove 30 for guiding the slider 25, but also contact jacks 32 for an audio plug. Apart from this, on the underneath of the audio shoe 20 it is also possible to see the end face of a rotary element 33. The axis of rotation of this rotary element runs parallel to the sliding direction 26 of the slider 25. Located on the rotary element 33 is a nose (not visible), which can be rotated into a corresponding groove or depression in the slider 25. I.e. the rotary element 33 is a securing element and can be turned from a first position to a second position. In the second position it engages into the slider 25 and prevents any movement in the opposite of the pushing-on direction 26. This means that with the rotary element 33 in this position the slider 25 cannot inadvertently be moved from its second position (locked position). The audio shoe 20 is thus secured twofold on the hearing aid housing 10.

Figure 11:
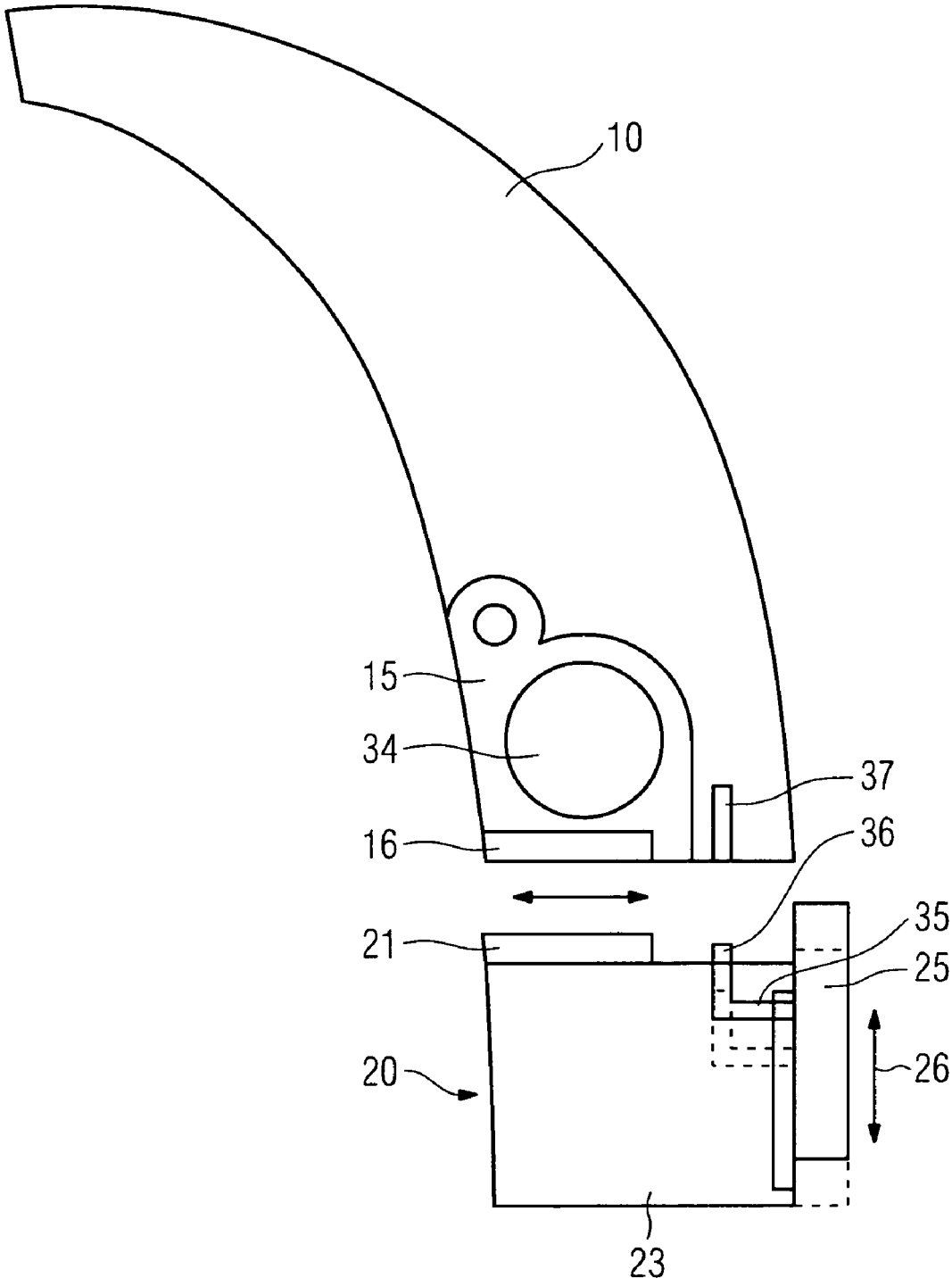
FIG. 11 a behind-the-ear hearing aid with audio shoe in accordance with an alternative form of embodiment.

FIG. 11 shows another form of embodiment of the present invention. As in the case of the preceding exemplary embodiment, here too the audio shoe 20 is to be fixed to the hearing aid housing 10 with a dovetail fixing 16, 21. The corresponding dovetail groove 16 is provided in the battery compartment 17, which accommodates a battery 34.

The slider 25 is joined by a vertically projecting arm 35 to the contacts 36 on the audio shoe. These contacts 36 thus move with the slider 25, in the push-on direction 26 or in the opposite direction, as applicable.

FIG. 11 shows the slider 25 in the closed position, so that the contacts 36 project above the surface of the audio shoe housing 23. With the slider in this position, the contacts 36 on the audio shoe 20 are then connected to the corresponding contacts 37 on the behind-the-ear hearing aid if the audio shoe is plugged onto the hearing aid housing 10. Otherwise, if the slider 25 is moved downward the contacts 36 are sunk in the audio shoe housing 23 (dashed position), so that there is no longer a connection to the contacts 37 on the hearing aid. Because the contacts 37 are located within the hearing aid housing 10, they can hardly get dirty when the audio shoe is not plugged on.

The two forms of embodiment illustrated above show two examples in which an audio shoe can advantageously be mounted on a hearing aid housing and electrically connected to it, using a double linear movement. The audio shoe is then robustly seated on the housing and in addition fits in well with the hearing aid design.

The invention claimed is:

1. A behind-the-ear hearing aid, comprising:

an elongated housing having an end face;

an audio shoe affixed to the end face such that the audio shoe is removable;

a coupling device with which the audio shoe is coupled to the housing by a sliding movement that is parallel to the end face; and a securing device attached to the audio shoe which includes a slider, the slider is movable crossways relative to the direction in which the audio shoe slides, wherein a first position permits the sliding movement of the audio shoe and a second position prevents the sliding movement, wherein a plurality of electrical contacts affixed on the slider, wherein when the slider is in the first position the electrical contacts move inside the interior of the housing of the audio shoe via the slider, and wherein when the slider is in the second position the electrical contacts project through the end face into the hearing aid housing.

2. The behind-the-ear hearing aid as claimed in claim 1, wherein the coupling device includes a dovetail guide.

3. The behind-the-ear hearing aid as claimed in claim 2, wherein a battery compartment is arranged on the end face, and wherein a dovetail groove for the dovetail guide is formed in the battery compartment.

4. The behind-the-ear hearing aid as claimed in claim 1, wherein the slider is arranged on the surface of the audio shoe to allow the slider to slide.

5. The behind-the-ear hearing aid as claimed in claim 1, wherein the plurality of electrical contacts are affixed on a side of the slider that faces the audio shoe, and wherein the electrical contacts establish electrical connections between the audio shoe and the housing when the slider is in the second position.

6. The behind-the-ear hearing aid as claimed in claim 1, wherein a securing element is arranged in the audio shoe, the securing element is rotatable about an axis of rotation that is parallel to the direction of movement of the slider, the securing element having a first position and a second position, wherein the slider is fixed in the second position of the slider when the securing element is in the second position of the securing element, and wherein the slider is freely movable when the securing element is in the first position of the securing element.

7. A method for coupling an audio shoe to a behind-the-ear hearing aid, comprising:

moving a guide element on the audio shoe linearly with respect to a guide element on the behind-the-ear hearing aid such that one of the guides slides into the other guide; and moving a slider perpendicularly to the moving of the guide elements such that the guide elements are inhibited from moving backwards relative the movement of the guide elements, a first position permits the sliding movement of the audio shoe and a second position prevents the sliding movement, providing a plurality of electrical contacts affixed on the slider, wherein when the slider is in the first position the electrical contacts move inside the interior of the housing of the audio shoe via the slider, and wherein when the slider is in the second position the electrical contacts project through the end face into the hearing aid housing.

* * * * *